US010555848B2

(12) United States Patent
Sachdev et al.

(10) Patent No.: US 10,555,848 B2
(45) Date of Patent: Feb. 11, 2020

(54) PORTABLE CUSHION AND METHOD OF USE

(71) Applicants: Harikrishan S. Sachdev, Laredo, TX (US); Koushalya S. Sachdev, Laredo, TX (US)

(72) Inventors: Harikrishan S. Sachdev, Laredo, TX (US); Koushalya S. Sachdev, Laredo, TX (US)

( * ) Notice: Subject to any disclaimer, the term of this patent is extended or adjusted under 35 U.S.C. 154(b) by 237 days.

(21) Appl. No.: 15/582,658

(22) Filed: Apr. 29, 2017

(65) Prior Publication Data

US 2018/0311089 A1 Nov. 1, 2018

(51) Int. Cl.
*A61G 5/10* (2006.01)
*A61G 7/057* (2006.01)
(Continued)

(52) U.S. Cl.
CPC ..... *A61G 5/1045* (2016.11); *A61G 7/05769* (2013.01); *A61G 7/05776* (2013.01); *A47C 7/74* (2013.01); *A47C 21/04* (2013.01); *A47C 27/10* (2013.01); *A61G 7/05738* (2013.01); *A61G 7/05761* (2013.01); *A61G 2203/46* (2013.01)

(58) Field of Classification Search
CPC ..... A47C 27/08; A47C 27/081; A47C 27/083; A47C 27/10; A47C 21/04; A47C 21/042; A47C 21/044; A47C 21/048; A47C 4/54; A47C 7/021; A47C 7/74; A61G 7/05769; A61G 7/05776; A61G 5/1043; A61G 5/1045
USPC ..... 5/654, 652, 652.1, 652.2, 653, 655.3, 5/706, 710–714, 724, 726, 421, 423, 644; 297/452.41–452.43, 180.1, 180.11
See application file for complete search history.

(56) References Cited

U.S. PATENT DOCUMENTS 3,303,518 A * 2/1967 Ingram ..... A47C 27/081 5/633
3,982,786 A * 9/1976 Burgin ..... A47C 4/54 297/284.3

(Continued)

FOREIGN PATENT DOCUMENTS

EP 0041037 12/1981

*Primary Examiner* — Robert G Santos
(74) *Attorney, Agent, or Firm* — Ira Domnitz

(57) ABSTRACT

A seating system for a chair in the form of a deflatable cushion. The two-inch-thick cushion, divided into nine rectangular sections, will have an open-end casing comprised of viscoelastic foam. The air compressor, connected to the battery power source, shoots pressurized gas into a check valve and then into branched rubber tubings. The sequence of deflation is as follows: pressurized gas passes through the air compressor's plastic compartment, which encases antibacterial liquid that the gas can pass through before entering the check valve. Having exited the air compressor and entered the check valve, the valve will regulate the flow of air to the cushion based on synchronization with the compressor and electronic feedback from the application or manual control. Having entered the check valve, the pressurized, sanitary gas enters the rubber tubings and the porous rubber tubes' eight subsections. This will cause deflation of the cushion. In addition, a heat sensor will be on the top-layer of the cushion and it can be linked to a computer for the user to monitor which areas of contact are too high in heat.

12 Claims, 4 Drawing Sheets

(51) Int. Cl.

| | |
|---|---|
| ***A47C 27/10*** | (2006.01) |
| ***A47C 21/04*** | (2006.01) |
| ***A47C 7/74*** | (2006.01) |

(56) References Cited

U.S. PATENT DOCUMENTS

| | | | | | |
|---|---|---|---|---|---|
| 3,987,507 | A | | 10/1976 | Hall | |
| 4,588,299 | A | | 5/1986 | Brown et al. | |
| 4,842,330 | A | | 6/1989 | Jay | |
| 4,852,195 | A | * | 8/1989 | Schulman | A61G 7/05776 5/713 |
| 4,864,671 | A | * | 9/1989 | Evans | A61G 7/05776 5/713 |
| 4,930,171 | A | | 6/1990 | Frantz | |
| 5,029,939 | A | * | 7/1991 | Smith | A61G 7/05776 297/284.1 |
| 5,193,237 | A | * | 3/1993 | Holdredge | A61G 5/1043 137/625.11 |
| 5,277,474 | A | * | 1/1994 | Hannagan | A47C 4/54 297/284.1 |
| 5,369,829 | A | | 4/1994 | Jay | |
| 5,379,471 | A | * | 1/1995 | Holdredge | A61G 5/1043 297/DIG. 8 |
| 5,457,833 | A | | 10/1995 | Jay | |
| 5,473,313 | A | | 12/1995 | Graebe | |
| 5,487,197 | A | | 1/1996 | Iskra | |
| 5,500,965 | A | * | 3/1996 | Hannagan | A61G 7/05776 297/452.41 |
| 5,509,155 | A | * | 4/1996 | Zigarac | A61G 5/1043 297/219.1 |
| 5,533,217 | A | * | 7/1996 | Holdredge | A61G 5/1043 5/710 |
| 5,592,706 | A | | 1/1997 | Pearce | |
| 5,606,754 | A | | 3/1997 | Hand | |
| 5,687,438 | A | * | 11/1997 | Biggie | A61G 5/1043 297/284.6 |
| 5,800,480 | A | | 8/1998 | Augustine | |
| 5,829,081 | A | | 11/1998 | Pearce | |
| 5,836,654 | A | | 11/1998 | DeBellis | |
| 5,839,140 | A | | 11/1998 | Wilkerson | |
| 5,857,749 | A | | 1/1999 | DeBellis | |
| 5,881,407 | A | * | 3/1999 | Chu Pt | A61G 5/1043 297/452.41 |
| 5,926,884 | A | * | 7/1999 | Biggie | A61G 7/05776 297/180.13 |
| 6,014,784 | A | | 1/2000 | Taylor | |
| 6,033,432 | A | | 3/2000 | Augustine | |
| 6,092,249 | A | | 7/2000 | Kamen | |
| 6,216,299 | B1 | * | 4/2001 | Kohlman | A61G 5/1043 5/654 |
| 6,560,803 | B2 | * | 5/2003 | Zur | A61G 7/05776 297/180.13 |
| 6,623,080 | B2 | * | 9/2003 | Clapper | A61G 5/1043 5/654 |
| 6,668,405 | B1 | * | 12/2003 | Kohlman | A61G 5/1043 297/452.41 |
| 7,392,557 | B1 | * | 7/2008 | Kohlman | A47C 4/54 297/452.41 |
| 7,441,294 | B2 | * | 10/2008 | Mossbeck | A47C 4/54 297/452.41 |
| 7,945,979 | B1 | * | 5/2011 | Lin | A61G 5/1043 5/653 |
| 8,312,569 | B2 | | 11/2012 | Myers | |
| 8,545,464 | B2 | | 10/2013 | Weston | |
| 8,602,271 | B2 | | 12/2013 | Winker et al. | |
| 9,814,637 | B2 | * | 11/2017 | Sazonov | A47C 21/044 5/423 |
| 2002/0027384 | A1 | * | 3/2002 | Zur | A61G 5/1043 297/452.41 |
| 2003/0030319 | A1 | * | 2/2003 | Clapper | A61G 5/1043 297/452.41 |
| 2008/0172797 | A1 | * | 7/2008 | Mossbeck | A61G 5/1043 297/284.6 |
| 2009/0265657 | A1 | | 10/2009 | Habbegger | |
| 2014/0345058 | A1 | * | 11/2014 | Escobedo et al. | A61G 7/05776 5/654 |
| 2015/0351981 | A1 | * | 10/2015 | Sazonov | A47C 27/082 5/713 |
| 2016/0317370 | A1 | * | 11/2016 | Evans et al. | A47C 27/082 297/452.41 |
| 2018/0311089 | A1 | * | 11/2018 | Sachdev | A61G 5/1045 |

* cited by examiner

PORTABLE CUSHION AND METHOD OF USE

CROSS-REFERENCE TO RELATED APPLICATIONS

Not applicable

STATEMENT REGARDING FEDERALLY SPONSORED RESEARCH

Not applicable.

BACKGROUND

Pressure ulcers continue to plague the lives of paraplegics, quadriplegics, bed-ridden patients, the disabled, et al. Pressure ulcers also known as pressures sores, bedsores, and decubitus ulcers, are localized injuries to the skin or underlying tissue that usually occur over a bony prominence as a result of pressure, or pressure in combination with shear and/or friction. Approximately one to three million people in the United States will develop pressure ulcers each year, and about sixty thousand people will die from pressure ulcer complications annually.

Based on current events, it is anticipated that the responsibility for individuals and providers to prevent and cater to pressure ulcers is much, greater. One solution is said to exist: relieving skin pressure over a bony prominence for five minutes every two hours, which will allow adequate perfusion and prevent tissue breakdown.

In one embodiment of the present invention, in order to overcome the problem of pressure sores and to contribute to a solution, a seating system in the form of a deflatable wheelchair cushion, divided into multiple compartments, is being proposed. In some embodiments, the wheelchair cushion contains a sand based top layer and an air pump that deflates one compartment at a time in a rotating motion. Thus, a portion of the user's buttocks will be continually relieved for fifteen minutes over a two-hour cycle.

In several embodiments, the present invention is different from the ones on the market in several ways: it contains an antibacterial component, rotates the pressure constantly throughout the chair, and provides a heat sensor on the top layer of the cushion for heat feedback. The products on the market do not provide those features.

One prior art piece Habegger—US 2009/0265857 operates with individual pressure compartments that are not connected. Habegger also utilizes a foam cylinder not found in the present invention. The present invention also uses pores on the surface cushion that allow for the release of air. The present invention also allows for the use of antibacterial agents to be released from pores.

Another piece of prior art Weston U.S. Pat. No. 8,545,464 operates with no pores and no air compartments. Weston also has a wound treatment apparatus not found in the present invention.

A third piece of prior art, Myers et al. U.S. Pat. No. 8,312,569, functions as an apparel garment with a padded portion. The invention of Myers is not a cushion and there are no compartments, unlike the present invention.

One other piece of prior art is Winker—U.S. Pat. No. 8,602,271, which is designed for patients with wounds. Winker contains a fluid impermeable membrane, which is not found in the present invention. In many embodiments, the present invention has air compression, unlike Winker.

Kamen et al.—U.S. Pat. No. 6,092,249, utilizes hollow foam members that does not have the constant air circulation of the present invention. Augustine et al. U.S. Pat. No. 6,033,432 is different from the present invention because it is solely for selectively cooling weight-bearing areas of the body in order to prevent or reduce damage. Taylor et al. U.S. Pat. No. 6,014,784, is made of "inflatable bladders" and does not have pores, unlike the present invention. Wilkerson U.S. Pat. No. 5,839,140 uses fluid-fillable cells rising from the base member. The present invention is filled with air and uses and air compressor. DeBellis et al. U.S. Pat. No. 5,857,749 is not compartmentalized and maintains a uniformed pressure throughout the whole cushion.

Pearce U.S. Pat. No. 5,829,081 is not filled with air and it does not adjust, unlike the present inventive device. Augustine et al. U.S. Pat. No. 5,800,480 is a mattress. Hand et al. U.S. Pat. No. 5,606,754 utilizes a predetermined pressure all around, and is a mattress for a hospital bed not a wheelchair cushion. Iskra, Jr. et al. U.S. Pat. No. 5,487,197 has the purpose of cushioning a user's coccyx, while our purpose is to prevent sores. In addition, their compartments are shaped differently and maintains constant inflation pressure. Graebe, Jr. U.S. Pat. No. 5,473,313 is a pump to work with a cushion. Jay U.S. Pat. No. 5,457,833 is a pad filled with fluid not air, unlike the present invention. Jay U.S. Pat. No. 5,369,829. Frantz U.S. Pat. No. 4,930,171 is a foam cushion with a fluid-filled pad. Jay U.S. Pat. No. 4,842,330 is a seat cushion is attached to a body engaging sling that is partially filled with fluid.

Jay U.S. Pat. No. 4,726,624 is a pad comprising of a flexible envelope containing a fluid filling material. Jay U.S. Pat. No. 4,588,299 is a fluid filling material. Hall U.S. Pat. No. 3,987,507 is made up of 3 pads of resilient foam material assembled on top of the other. Hall uses foam instead of air. EP 0 041 037 has one compartment and has layers of foam on top of it. It is not compartmentalized Chinese Patent Application 2004/20104890 is a cushion with springs not an air cushion.

SUMMARY

In several embodiments, the proposed invention is a wheelchair cushion that would have compartments/divisions that would be individually inflated by air compressors. One purpose of this development is to reduce the risk of bed sores and damage to the body that commonly occurs as a result of excess pressure applied on the skin for long durations of time.

In several embodiments, the present invention would function where one compartment would deflate at a time. (As of now we are thinking that there will be a total of four to eight compartments). The deflated compartment would rotate one a time scheduled so that each part of the skin receives a release of pressure for a certain period of time, every so often. This would be done h placing small tubes inside the cushion and having them inflate with air compressors, individually. The air would be deflated from the pores on the surface of the cushion.

In several embodiments, the control center of the innovation would be an application on a phone or alternatively a remote. Additional features would include a heat sensor on the surface of the cushion so that the user can monitor on their smartphone which areas of the skin is too hot. There would also be an antibacterial mist that would be released with the air to further prevent infection and overheating of the skin. The last additional feature would be a weight scale included in the cushion so that the user can monitor their day-to-day weight on the chair.

In several embodiments, the present invention is an inflatable cushion comprising; a upper cushion portion; said cushion further comprising side walls, a sectioned perforated top surface; and a hollow interior; a middle cushion portion; said middle portion further comprising middle side walls, a middle perforated top surface and a hollowed interior divided in sections with interior middle dividers; a bottom board; said bottom board further comprising a solid base and three fluid flow tubes; said three fluid flow tubes further comprising each individual fluid flow tube is in mechanical communication with three air containment modules; wherein said upper cushion forms a covering over said middle cushion; and said middle cushion forms a covering over said bottom board wherein each of said air containment modules is housed individually into a section created by said interior middle dividers. In several embodiments, said three fluid flow tubes are attached to a tube with three attachments through openings in said middle side walls and said side walls. In several embodiments, said tube is attached to secondary tube; said secondary tube is attached to an air pump. In several embodiments, said tube is attached to secondary tube; said secondary tube is attached to an air pump and a medication pump. In several embodiments, said air pump is electrically attached to receiver, a battery source and a controller. In several embodiments, said controller is electrically attached to said individual air containment modules therein controlling the release or activation of each of said modules, said secondary tube is attached to an air pump.

In several embodiments the present invention is an inflatable cushion comprising; a upper cushion portion; said cushion further comprising side walls, a sectioned perforated top surface; and a hollow interior; a middle cushion portion; said middle portion further comprising middle side walls, a middle perforated top surface and a hollowed interior divided in sections with interior middle dividers; a bottom board; said bottom board further comprising a solid base and three fluid flow tubes; said three fluid flow tubes further comprising each individual fluid flow tube is in mechanical communication with three air containment modules; wherein said upper cushion forms a covering over said middle cushion; and said middle cushion forms a covering over said bottom board wherein each of said air containment modules is housed individually into a section created by said interior middle divider; said three fluid flow tubes are attached to a tube with three attachments through openings in said middle side walls and said side walls; said tube is attached to secondary tube; said secondary tube is attached to an air pump and a medication pump; said air pump is electrically attached to receiver, a battery source and a controller. said controller is electrically attached to said individual air containment modules therein controlling the release or activation of each of said modules.

In several embodiments the present invention is a method for inflating a cushion comprising the steps of; providing an inflatable cushion with an upper cushion portion; said cushion further comprising side walls, a sectioned perforated top surface; and a hollow interior; a middle cushion portion; said middle portion, further comprising middle side walls, a middle perforated top surface and a hollowed interior divided in sections with interior middle dividers; a bottom board; said bottom board further comprising a solid base and three fluid flow tubes; said three fluid flow tubes further comprising each individual fluid flow tube is in mechanical communication with three air containment modules; wherein said upper cushion forms a covering over said middle cushion; and said middle cushion forms a covering over said bottom board wherein each of said air containment modules is housed individually into a section created by said interior middle dividers said three fluid flow tubes are attached to a tube with three attachments through openings in said middle side walls and said side walls said tube is attached to secondary tube; said secondary tube is attached to an air pump and a medication pump said air pump is electrically attached, to receiver, a battery source and a controller; said controller is electrically attached to said individual air containment modules therein controlling the release or activation of each of said modules; sending a signal from said controller to said air pump to pump air into said secondary tube; sending a signal from said controller to one of said individual air containment modules to either open or release air from said module. In several embodiments, there is the additional step of sending a signal from said controller to said medication pump to release medication into said secondary tube.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
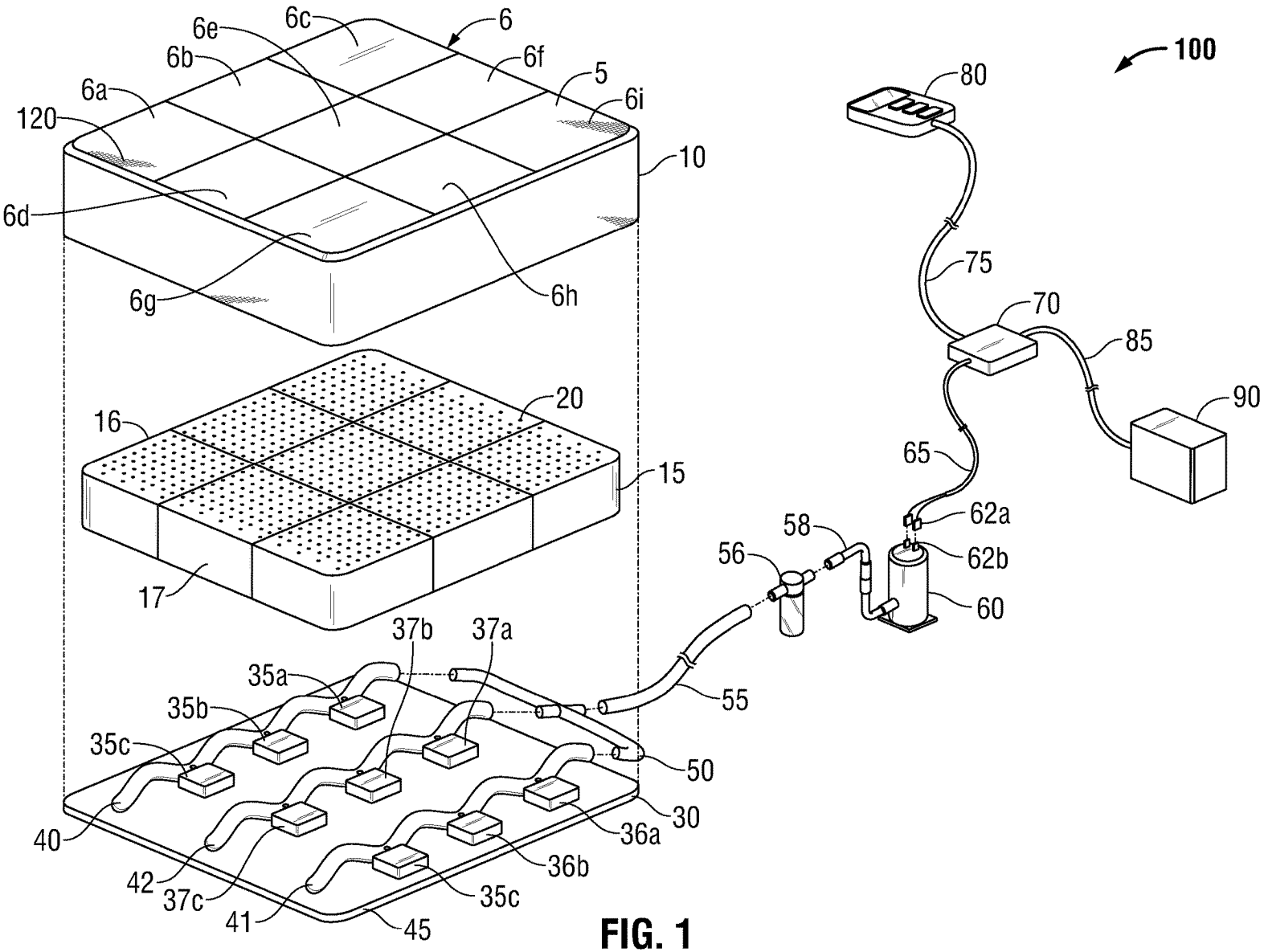
FIG. 1 is an exploded view of one embodiment of the present invention.

One or more illustrative embodiments incorporating the invention disclosed herein are presented below. Applicant has created a revolutionary and novel portable cushion and method of use of the same.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details, concerning, such considerations and the like have been omitted, inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

FIG. 1 shows one embodiment of the present invention in an exploded form. The present inventive cushion 100 is illustrated. As shown the horizontal surface of the cushion 5 is preferably designed to be semi-pliable but formed to hold the shape of substantially an outer edge wall. Horizontal surface 5 can be comprised of a plurality of materials both natural and synthetic. Horizontal surface 5 forms the upper face of the cushion upper cover 6. As shown in some embodiments, upper cover 6 is defined by vertical walls 10 and horizontal surface 5.

As shown inner cushion 15 is preferable designed to be a hollow frame with a top surface 16 and side wall edge 17. Inner cushion 15 is designed to comfortably and pliably support a user. The upper top surface 16 is preferably constructed with perforations or pores 20 designed for the egress of air and gas exiting the cushion compartments.

Further shown is the bottom hoard 30 of one embodiment of the present invention. As shown three gas tubes 40, 41, 42 and preferably arranged in parallel such that the ends of the tubes exit off of the bottom board 30 and may attach to the air tube 50. As shown, air containment modules 35*a*, 35*b*, and 35*c* are attached to tube 40 and designed to hold the air in compartments without spreading, with the goal being to keep air in the varying compartment combinations. As shown, air containment modules 36*a*, 36*b*, and 36*c* are attached to tube 11 and designed to hold the air in the appropriate compartment. As shown, air containment modules 37*a*, 37*b*, and 37*c* are attached to tube 42 and designed to hold the air in the appropriate compartment. The vertical edge 45 of cushion pad with pipes is preferably designed to support the weight of a user.

As shown air tube 50 separates into two different passages to attach to tubes 40 and 41 in the cushion. Likewise, tube 50 attaches to air tube 55 designed to move air towards the cushion for distribution while in use. Further shown, compartment 56 can carry medication inside of it and humidify it into the air that Will flow into tube 55. Pipe 58 connects the air pump 60 to the medication container, or compartment 56. Air pump 60 is an air pump/air compressor as is known in the industry. 62*a* and 62*b* are electrical wires from the battery, indicated by 90 on the drawings, to power the air pump 60. Electrical wire 65 is covered in a sheath to protect it in the manner normally known in the art.

Receiver 70 is also attached to the air pump 60. The purpose of the receiver is to receive the signal from the remote and convert the signal to instructions to the pump. Wire 75 that connects the remote control 80 to the receiver 70. Wire 85 connects the receiver 70 to the battery 90.

Figure 2:
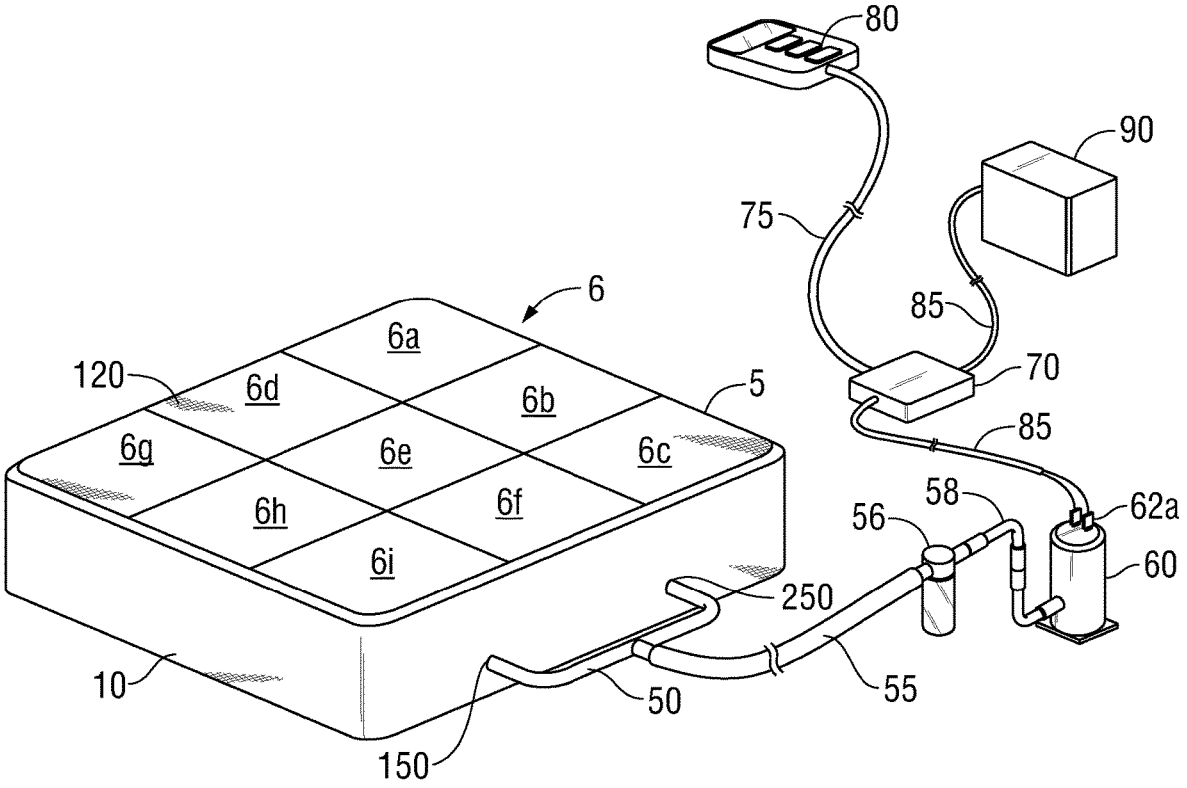
FIG. 2 is an assembled side view of one embodiment of the present invention.

FIG. 2 illustrates one embodiment of the present invention in assembled form. As shown upper cover 6 in mechanically place over inner cushion 15 and attached to bottom board 30 (FIG. 1). In many embodiments, these three elements are attached as a single functional unit. Further shown are the two connection ports 150 and 250 on the exterior of one side of the connection between the tube 50 and the cushion wall 10. Subsections 6*a*-6*i* are the sections of top cushion 6 which have varying air mists pushed through the perforations located on the surface of the cushion mesh cover 120.

Figure 3:
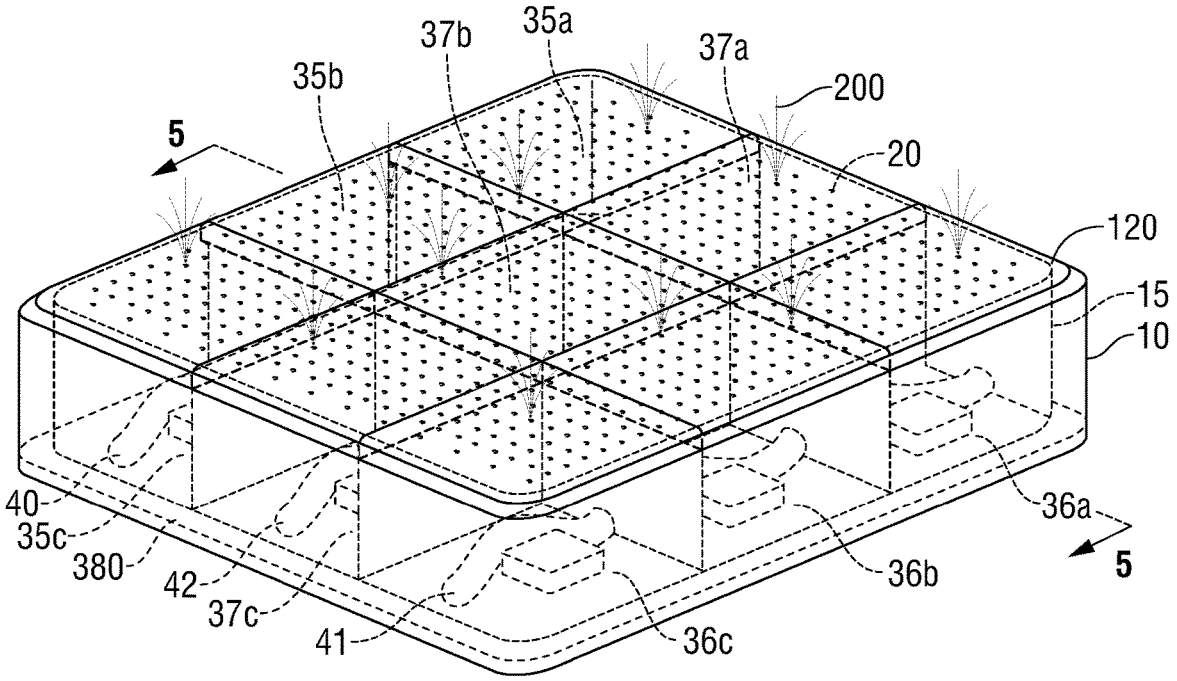
FIG. 3 is an assembled side view of one embodiment of the present invention in partial transparency.
Figure 4:
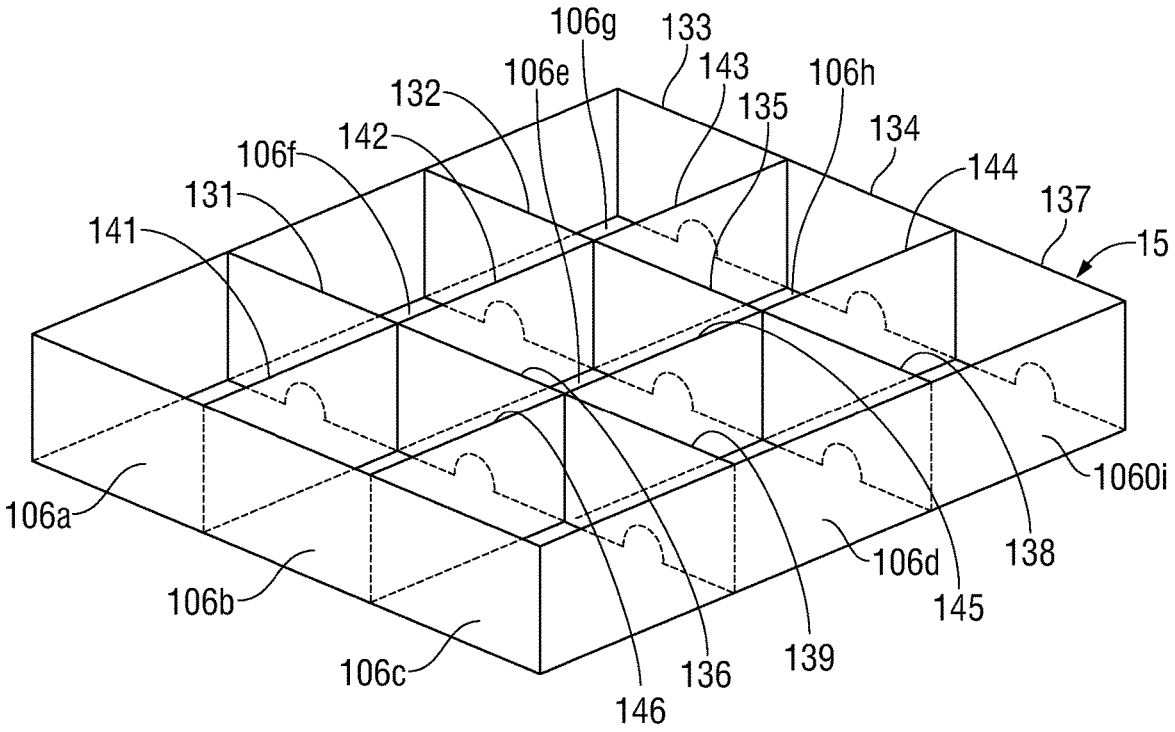
FIG. 4 is an assembled side view of one embodiment of the present invention in partial transparency of the lower sections of the cushion.

FIG. 3 illustrates one embodiment of the present invention in partial transparency. Medicated air 200 is being released from the pores 20 on the inner cushion 15 and then through the perforations on subsections 6*a*-I on the top cushion 6. FIG. 4 shows the additional divider walls 131, 132, 133, 134, 135, 136, 137, 138 and 139, which have orifices designed have the tubes 40, 41, and 42 pass through them in a tight seal such that air cannot escape between divided sections. The sections 106*a-i* are further defined by dividing walls 141, 142, 143, 144, 145, and 146 which are substantially in airtight seal with the corresponding adjacent walls. In each section 106*a-i* there is air containment module that is in electronic communication with controller 80. During operation is it envisioned that individual controllers can be activated individually to allow air to flow into each individual subsection 160*a-i*. Further drawing of the sections 106*a-i* included in FIG. 4.

FIG. 4 illustrates one embodiment, of the interior frame 115 shown inner cushion 15 is preferable designed to be a hollow frame 115 with a top surface 16 and side wall edge 17 (FIG. 1). Inner cushion 15 is designed to comfortably and pliably support a user. The upper top surface 16 is preferably constructed with perforations or pores 20 designed for the egress of air and gas exiting the cushion compartments. FIG. 4 shows the additional divider walls 131, 132, 133, 134, 135, 136, 137, 138 and 139, which have orifices designed have the tubes 40, 41, and 42 pass through them in a tight seal such that air cannot escape between divided sections. The sections 106*a-i* are further defined by dividing walls 141, 142, 143, 144, 145, and 146 which are substantially in airtight seal with the corresponding adjacent walls. In each section 106*a-i* there is air containment module that is in electronic communication with controller 80. During operation is it envisioned that individual controllers can be activated individually to allow air to flow into each individual subsection 106*a-i*. Further drawing of the sections 106*a-i* included in FIG. 4.

Figure 5:
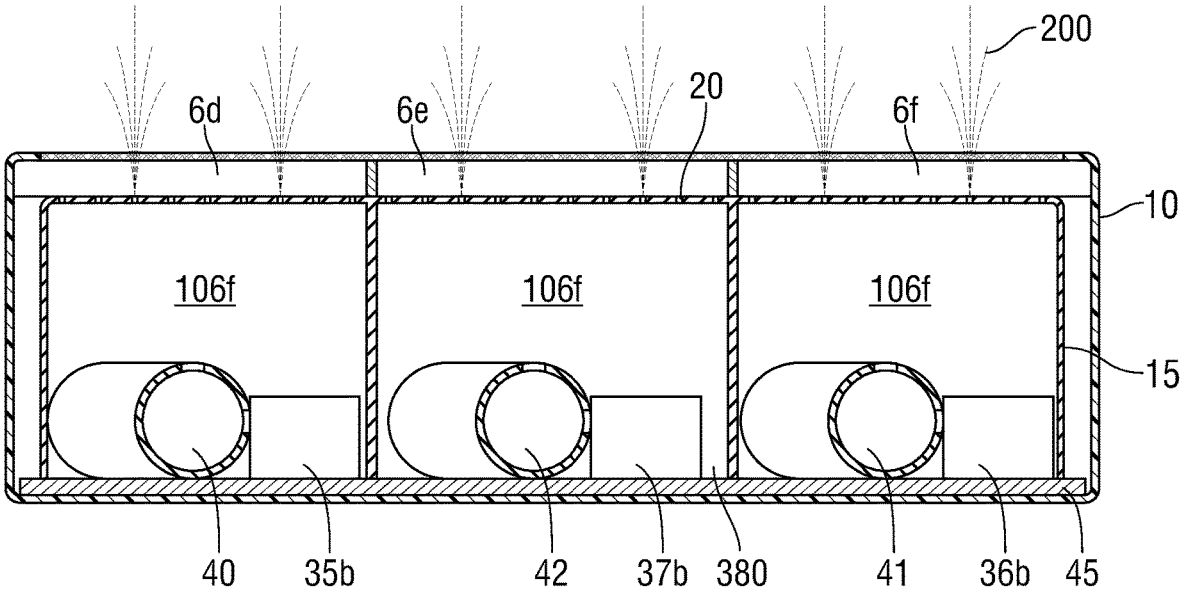
FIG. 5 is a partial side cross sectional view of one embodiment.

FIG. 5 illustrates a partial cross sectional side view of one embodiment of the present invention. As shown, tube 41 is attached to air containment module 36*a, b*, and *c* through port 43. Tube 41 is attached to inner cushion 15 through port 47. The ports 47 and 48 are left open for the air to openly flow from the tubes to the cushion 15. Ports 42 and 43 are controlled by 35*b* and 36*b*. When allowed by 35*b* and 36*b*, air will flow into the tubes 41 and 40. As shown, tube 40 is attached to air containment module 35*a* through port 42. Tube 40 is attached to inner cushion 15 through port 48. Also shown is the empty air vacuum space between the two tubes (40, 41).

Figure 6:
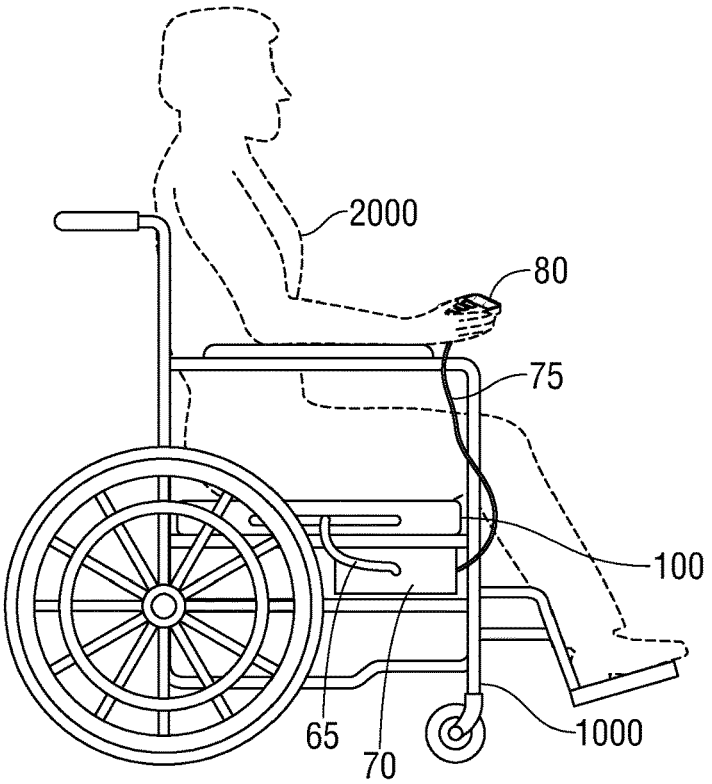
FIG. 6 is a view of a user sitting on the device in a deflated mode.

FIG. 6 illustrates one embodiment of the present invention with a user 2000 sitting on the inventive cushion 100. As shown the user 2000 is sitting in a wheelchair 1000 which is a wheelchair s known commonly in the art. A wheelchair provides the user the ability to be mobile. It can be either manually powered or automated, and in this case, it is manually powered. The user 2000 is holding remote control 80 and the control 80 is attached to receiver 70 as is earlier described. Inventive cushion 100 is in a deflated mode in this illustration.

Figure 7:
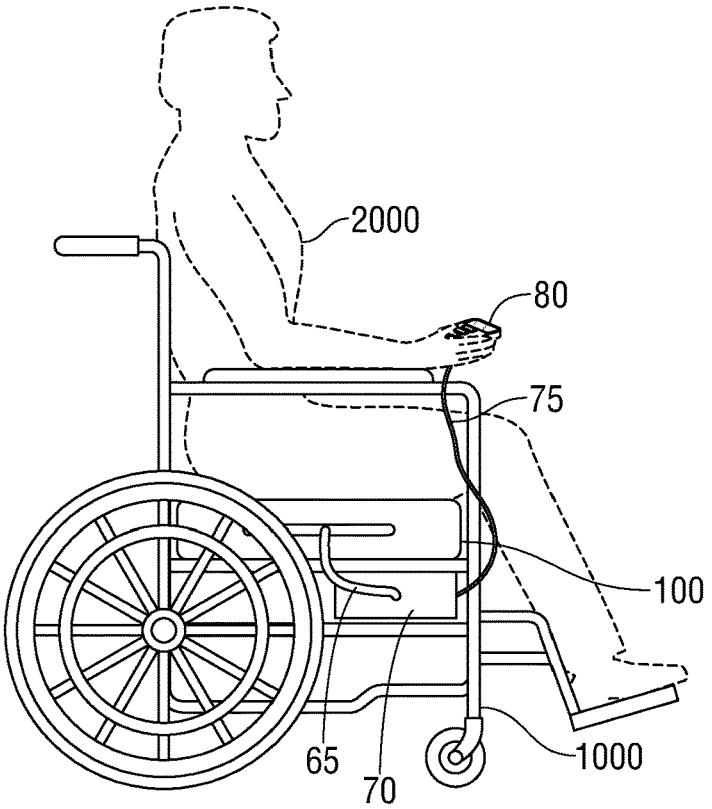
FIG. 7 is a view of a user sitting on the device in an inflated mode.

FIG. 7 illustrates one embodiment of the present invention in which the cushion 100 is inflated with air to the highest capacity. That is why the individual (2000) is elevated in contrast to FIG. 5. These two figures were included to show the variance of the cushions inflation levels.

While preferred embodiments have been shown, and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Accordingly, it is intended that the following claims be interpreted to embrace all such variations and modifications.

We claim:

1. An inflatable cushion comprising;
an upper cushion portion;
said cushion further comprising side walls, a sectioned perforated top surface; and
a hollow interior;
a middle cushion portion;
said middle portion further comprising middle side walls, a middle perforated top surface and a hollowed interior divided in sections with interior middle dividers;
a bottom board;
said bottom board further comprising a solid base and three fluid flow tubes;
wherein each individual fluid flow tube is in mechanical communication with three air containment modules; wherein
said upper cushion forms a covering over said middle cushion; and
said middle cushion forms a covering over said bottom board wherein each of said air containment modules is housed individually into a section created by said interior middle dividers.

2. The inflatable cushion of claim 1 further comprising;
said three fluid flow tubes are attached to a tube with three attachments through openings in said middle side walls and said side walls.

3. The inflatable cushion of claim 2 further comprising;
said tube is attached to a secondary tube;
said secondary tube is attached to an air pump.

4. The inflatable cushion of claim 2 further comprising;
said tube is attached to a secondary tube;
said secondary tube is attached to an air pump and a medication pump.

5. The inflatable cushion of claim 3 or 4 further comprising;
said air pump is electrically attached to a receiver, a battery source and a controller.

6. The inflatable cushion of claim 5 further comprising;
said controller is electrically attached to said individual air containment modules therein controlling the release or activation of each of said modules.

7. The inflatable cushion of claim 6 further comprising;
said inflatable cushion is attached to the seating portion of a wheel chair.

8. An inflatable cushion comprising;
an upper cushion portion;
said cushion further comprising side walls, a sectioned perforated top surface; and
a hollow interior;
a middle cushion portion;
said middle portion further comprising middle side walls, a middle perforated top surface and a hollowed interior divided in sections with interior middle dividers;
a bottom board;
said bottom board further comprising a solid base and three fluid flow tubes;
wherein each individual fluid flow tube is in mechanical communication with three air containment modules; wherein
said upper cushion forms a covering over said middle cushion; and
said middle cushion forms a covering over said bottom board wherein each of said air containment modules is housed individually into a section created by said interior middle dividers;
said three fluid flow tubes are attached to a tube with three attachments through openings in said middle side walls and said side walls;
said tube is attached to a secondary tube;
said secondary tube is attached to an air pump and a medication pump;
said air pump is electrically attached to a receiver, a battery source and a controller;
said controller is electrically attached to said individual air containment modules therein controlling the release or activation of each of said modules.

9. The inflatable cushion of claim 8 further comprising;
said inflatable cushion is attached to the seating portion of a wheel chair.

10. A method for inflating a cushion comprising the steps of;
providing an inflatable cushion with
an upper cushion portion;
said cushion further comprising side walls, a sectioned perforated top surface; and
a hollow interior;
a middle cushion portion;
said middle portion further comprising middle side walls, a middle perforated top surface and a hollowed interior divided in sections with interior middle dividers;
a bottom board;
said bottom board further comprising a solid base and three fluid flow tubes;
wherein each individual fluid flow tube is in mechanical communication with three air containment modules; wherein said upper cushion forms a covering over said middle cushion; and said middle cushion forms a covering over said bottom board wherein each of said air containment modules is housed individually into a section, created by said interior middle dividers;

said three fluid flow tubes are attached to a tube with three attachments through openings in said middle side walls and said side walls;

said tube is attached to a secondary tube;

said secondary tube is attached to an air pump and a medication pump;

said air pump is electrically attached to a receiver, a battery source and a controller;

said controller is electrically attached to said individual air containment modules therein controlling the release or activation of each of said modules;

sending a signal from said controller to said air pump to pump air into said secondary tube;

sending a signal from said controller to one of said individual air containment modules to either open or release air from said module.

11. The method of claim 10 further comprising the step of sending a signal from said controller to said medication pump to release medication into said secondary tube.

12. The method of claim 11 further comprising;

attaching said inflatable cushion to the seating portion of a wheel chair.

* * * * *